United States Patent [19]

Müller

[11] Patent Number: 4,833,753

[45] Date of Patent: May 30, 1989

[54] FILTER APPARATUS, IN PARTICULAR ON VACUUM CLEANERS

[76] Inventor: Urs Müller, Langackerstrasse 10, CH-8442 Hettlingen, Switzerland

[21] Appl. No.: 33,283

[22] Filed: Apr. 2, 1987

[51] Int. Cl.[4] ..... A47L 9/12

[52] U.S. Cl. ..... 15/339; 15/347; 15/352; 55/309; 55/422; 55/486

[58] Field of Search ..... 15/339, 349, 352; 55/309, 422, 482, 486

[56] References Cited

U.S. PATENT DOCUMENTS

| | | | |
|---|---|---|---|
| 684,692 | 10/1901 | Jarvis | 55/422 |
| 1,004,195 | 9/1911 | Porter | 55/422 X |
| 1,107,715 | 8/1914 | Sharpneck | 15/344 X |
| 2,293,920 | 8/1942 | Replogle | 15/339 X |
| 2,467,652 | 4/1949 | Beede | 15/339 X |
| 3,477,087 | 11/1969 | Robinson | 15/344 |
| 4,279,629 | 7/1981 | Simms | 55/422 X |

*Primary Examiner*—Chris K. Moore

*Attorney, Agent, or Firm*—Pollock, VandeSande and Priddy

[57] ABSTRACT

In order to permit the passage of dust and coarse particles or only the former, and to allow continuous operation, a filter disk is arranged in a housing, in the air flow direction, so that it is rotatable to different operating positions. A diaphragm-like valve can be provided upstream of the filter disk, at the inlet of the air stream in the housing. The filter disk is arranged on an axle which is mounted in the filter housing and has an actuating element for rotation. In addition to the rotatable filter disk, an additional filter disk can be arranged a distance away, the additional filter disk being designed for fine filtration and being removably clamped between two parts of the housing parts.

4 Claims, 2 Drawing Sheets

FILTER APPARATUS, IN PARTICULAR ON VACUUM CLEANERS

In portable and mobile vacuum cleaners having an electrically operated fan, the dust-laden air sucked in flows through a paper or fabric filter. Depending on use, the filter dust bag has to be cleaned or replaced after shorter or longer intervals, necessitating a time-consuming operation. During suction, the coarse particles pass together with the dust into the dust bag, and the removal of these particles is inconvenient and unhygienic.

The invention relates to a filter apparatus, in particular on vacuum cleaners. It is the object of the invention to ensure continuous operation even where large amounts of dirt or dust are involved, to carry out cleaning easily and rapidly and optionally to permit or prevent dust and coarse particles from flowing through. It is a further object to permit self-cleaning without opening the housing in which the filter is located.

Figure 1:
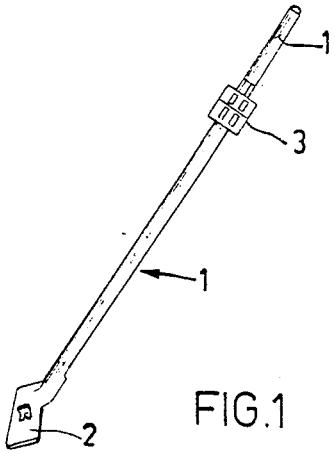
Figure 3:
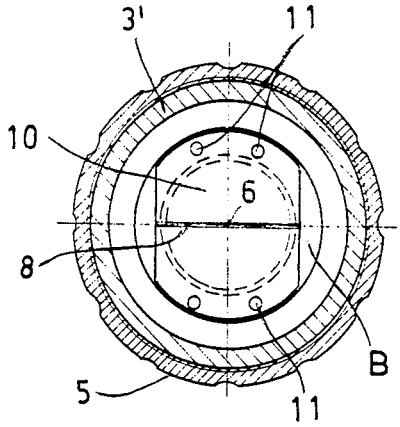
Figure 2:
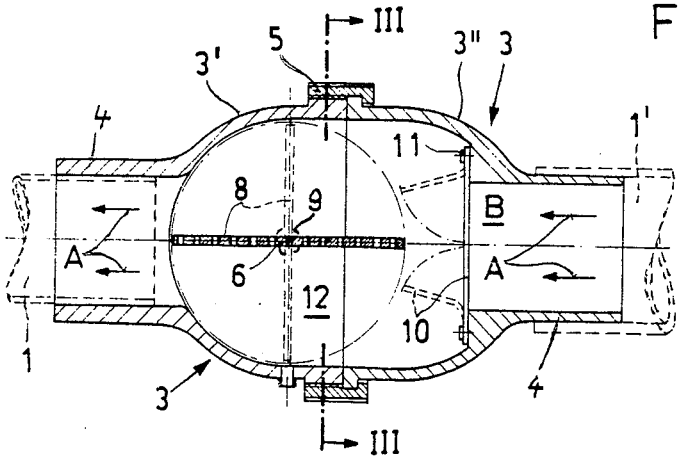
Figure 4:
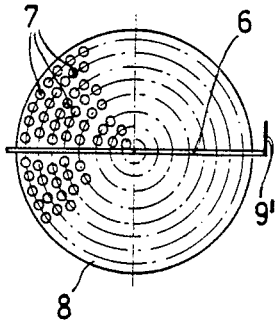
Figure 5:
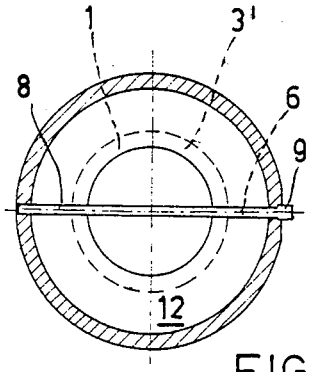
Figure 6:
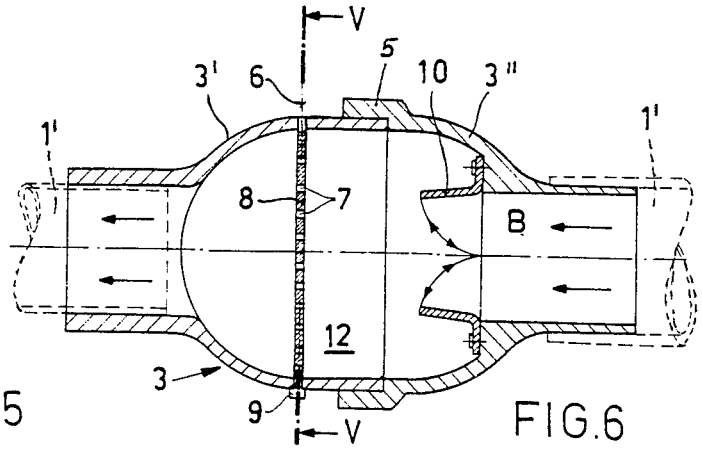
Figure 9:
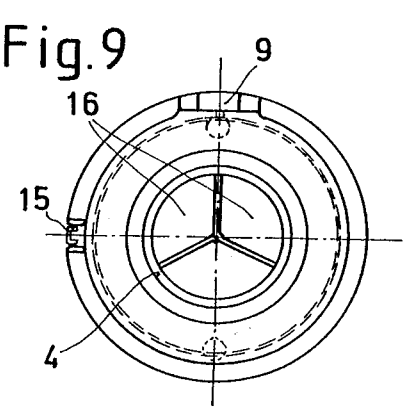
Figure 7:
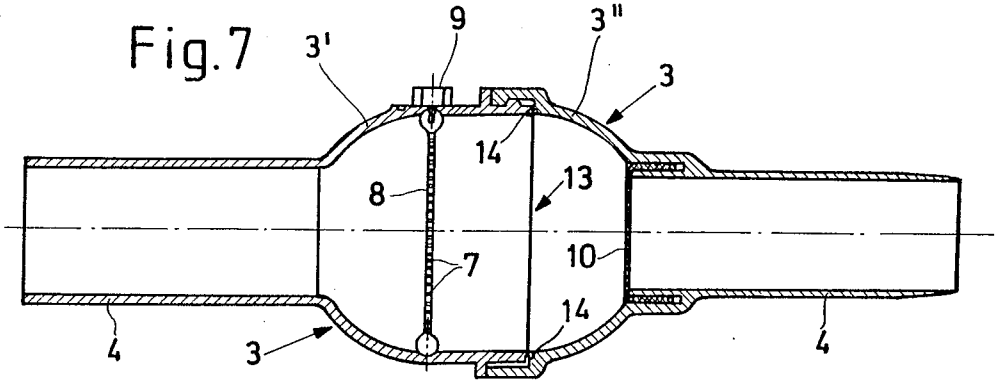
Figure 8:
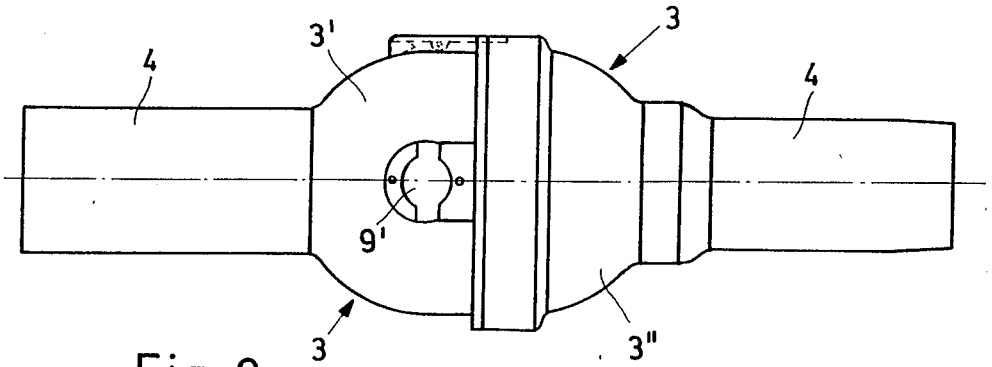

Two embodiments of the invention are described with reference to the drawing, in which FIG. 1 shows a side view of a vacuum cleaner having a filter apparatus, in a first embodiment, FIG. 2 shows a longitudinal section of the filter apparatus on a larger scale, the filter body being in the open position but the diaphragm valve in the closed position, FIG. 3 shows a cross-section along the line III—III in FIG. 2, FIG. 4 shows a front view of the filter disk alone, FIG. 5 shows a cross-section along line V—V in FIG. 6, without the filter disk, FIG. 6 shows a longitudinal section as in FIG. 2, the filter apparatus being in the operating position with an open diaphragm valve in a variant of the filter housing, FIG. 7 shows a side view of the filter apparatus in a second embodiment, FIG. 8 shows a longitudinal section of the same and FIG. 9 shows a front view of a diaphragm.

In FIG. 1 to 6, 1 denotes an air pipe serving as a handle in a conventional manner, 2 denotes the suction nozzle to be guided over the surface to be cleaned, 3 denotes the filter housing connected to the air pipe 1, and 1′ denotes the air pipe which leads to the hose and mobile fan, which are not shown. The filter housing 3 consists of at least two housing parts 3′, 3″ (FIG. 6) which are partially inserted one into the other and which have larger diameters than the air pipe 1. The air pipes 1, 1′ are connected to pipe connections 4 of the filter housing 3 which are opposite one another and have smaller diameters than the said housing. The two parts 3′, 3″ of the filter housing 3 can also be connected to one another by a screw bushing 5 (FIG. 2) which is ribbed at the periphery, or by an integral molded inner or outer thread.

A flat, dimensionally stable filter disk 8, (FIG. 2) which is provided with holes 7 and is present in the direction of flow of the air stream, is interchangeably mounted in housing part 3′, on an axle 6 which passes transversely through the said housing part. An end part of the axle 6 projects from the housing part 3′ and has a manual actuating element 9, so that the filter disk 8 can be adjusted by rotation in the air flow direction indicated by arrow A. The actuating element 9 is a cylindrical head in FIG. 2 and 5 and a toggle lever 9′ in FIG. 4. In the region of the air flow inlet B, an automatic diaphragm valve 10 is fastened in housing part 3″ by screws or rivets 11.

Before the intake of air and during shut-down, the diaphragm 10 assumes the position shown in FIG. 2. When air which has been sucked in enters the filter housing 3, the diaphragm valve 10 is opened, as indicated by the dashed lines in FIG. 2, and the air reaches the filter disk 8. Entrained coarse particles fall off the filter disk 8 and pass into collecting space 12, part of the underneath of which is defined by the inner walls of housing parts 3′, 3″. On the other hand, fine particles pass through the holes 7 in filter disk 8. When the holes 7 are partially or completely blocked, the axle 6 is rotated through 180 degrees with respect to the position shown in FIG. 2 by means of actuating element 9, so that the air stream flows through the filter disk 8 from behind and carries away any foreign substances completely or partially blocking the holes 7.

If the filter housing 3 is opened, before the fan generating the air flow can be switched off, the coarse particles present in the collecting space 12 can easily be removed. When the fan is switched off and the air stream consequently stopped, the diaphragm valve 10 closes automatically to the position shown in full line in FIG. 2 and prevents accumulated foreign bodies from falling back. To clean the filter disk, the latter is simply brought to the position shown in FIG. 2 by means of the actuating element 9 or 9′ and the axle 6.

Because the filter disk 8 can be adjusted, continuous operation of the vacuum cleaner is possible. Cleaning can be carried out more rapidly and without inconvenience and does not require any manual skill. FIG. 2 shows the position of the filter disk in which dust and coarse particles can be entrained together by the air stream and can pass the filter housing, from where the said dust and coarse particles pass through the air pipe 1′ into the connected dust bag at the fan.

The filter apparatus for vacuum cleaners is suitable for all kinds of private and industrial use and can easily be installed in new and existing models.

For fine filtration, the filter disk 8 can be covered with a dry or moistened fabric web. The fabric webs must be fastened by, for example, edge clamps of the filter disk.

In a vacuum cleaner in which the fan and dust bag are located directly adjacent to the suction nozzle 2 in handle 1, the filter housing 3′ with filter disk 8 must be arranged between the two parts 1 and 2.

Since the housing 3, 3′ consists of transparent, impact-resistant plastic, the amount and type of coarse particles can be determined without opening the filter.

Furthermore, self-cleaning is achieved simply by rotating the filter element 8, without opening the housing 3, 3′.

The filter element 8 can be designed for coarse and fine filtration and may be rapidly and easily interchanged with elements having other hole sizes, particularly where the housing 3 consists of three parts.

In FIG. 7, the parts denoted by reference symbols have the same meaning as in the first embodiment according to FIG. 1 to 6. The essential difference is that a second fine filter disk 13 is arranged a distance away from filter disk 8 in housing part 3″. This fine filter disk 13 has tiny holes, which are not shown. A porous paper or fabric filter film, which is likewise not shown, is stretched over the fine filter disk 13. The peripheral edge of fine filter disk 13 is clamped between the adjacent sides 14 of housing parts 3′, 3″ and, in contrast to filter disk 8, is stationary and removable. The said fine filter disk is used only when required, in particular for searching for or filtering very fine particles. The actuating element 9 for rotating filter disk 8 is in the form of a rotary switch. 15 denotes a lock to prevent undesired rotation of housing parts 3', 3'' with respect to one another. This can be in the form of a projecting, resilient cam on housing part 3'', the said cam engaging a depression in housing part 3'. Valve 16 is once again a conventional flexible diaphragm with three radial cuts.

The filter apparatus can be used wherever it is necessary to separate solid particles from gaseous media. The filter apparatus can be incorporated in ventilation units of any kind.

The filter apparatus described is a hardware filter, in particular for vacuum cleaners and ventilators, and is preferably installed in a suction pipe, as shown in FIG. 1. The said filter apparatus removes from the air stream the entrained parts generally sucked in unintentionally, such as jewellery, parts of toys, screws, fibers, hairs, dirt particles etc., and retains them in housing 3. To remove the retained parts from housing 3, the latter is opened by simply rotating housing parts 3', 3'' in opposite directions. The rotation lock 15 prevents automatic opening of the housing 3 during operation. Because the housing 3 consists of transparent, impact-resistant plastic, the contents can be optimally checked without the filter apparatus having to be opened. The filter disk 8 is operated from outside by means of actuating element 9 and cleans itself when required, if brought into the position shown in FIG. 1. The diaphragm 10 which acts as a valve closes automatically when the motor is switched off, and prevents material from falling back into air pipe 1'.

I claim:

1. A filter apparatus for use in an air flow system of the type comprising an air pipe that is connected to a fan, said filter apparatus comprising a housing that is disposed in said air pipe, said housing having an air inlet and an air outlet for passing air and particles entrained in said air in a predetermined air flow direction through said air pipe and housing, a flat sided filter element mounted for rotation within said housing, said filter element having a plurality of apertures therein, means for rotating said filter element to a first position within said housing wherein said rotatable filter element extends across said housing in a direction transverse to said air flow direction with one of the flat sides of filter element facing said air inlet and the other flat side of said filter element facing said air outlet to permit dust particles which are entrained in said air flow to pass through said apertures in said filter element while preventing the passage through said filter element of coarser particles entrained in the air flow, thereby to collect said coarser particles in said housing, said means for rotating being operable to rotate said filter element into a second position within said housing, displaced 180° from said first position, wherein said rotatable filter element extends across said housing in a direction transverse to said air flow direction with said one side of said filter element facing said air outlet and said other side of said filter element facing said air inlet to permit the air flowing through said housing to clean said filter element of particles which have completely or partially blocked said apertures in said filter element, said means for rotating said filter element also being operable to rotate said filter element into a third position, located between said first and second positions wherein the two flat sides of said rotatable flat filter element are oriented in directions substantially parallel to the direction of air flow through said housing to permit air and particles entrained therein to pass from said air inlet to said air outlet in said housing along the two flat sides of said filter element simultaneously, and an additional filter element located in said housing in spaced relation to said rotatable filter element.

2. The filter apparatus of claim 1 wherein said additional fine filter element is disc-shaped, and means for clamping said additional filter element in said housing so that it is stationary and replaceable.

3. The filter apparatus of claim 1 including valve means mounted in said housing between said air inlet and said rotatable filter element, said valve means being opened in response to said air flow and being operable to close automatically when the air flow through said air pipe and housing ceases thereby to prevent the passage into said air inlet of particles which have been collected in the portion of said housing between said valve means and said rotatable filter element.

4. The filter apparatus of claim 1 wherein said rotatable filter element is disc-shaped, said filter element being mounted for rotation within said housing, through 360°, on a rotatable shaft that extends diametrically across said disc-shaped filter element, one end of said shaft extending through a wall of said housing to the exterior of said housing, and an actuating element attached to said one end of said shaft.

* * * * *